US006925665B1

(12) United States Patent
Hennings

(10) Patent No.: US 6,925,665 B1
(45) Date of Patent: Aug. 9, 2005

(54) MULTIPLE CONFIGURATION BED FRAME SYSTEM

(76) Inventor: Eric Hennings, 1970 Garner Ave., Moville, IA (US) 51039

( * ) Notice: Subject to any disclaimer, the term of this patent is extended or adjusted under 35 U.S.C. 154(b) by 0 days.

(21) Appl. No.: 10/278,438

(22) Filed: Oct. 23, 2002

(51) Int. Cl.[7] ..... A47C 19/20
(52) U.S. Cl. ..... 5/200.1; 5/8; 5/9.8
(58) Field of Search ..... 5/200.1, 2.1, 8, 5/9.1, 9.8

(56) References Cited

U.S. PATENT DOCUMENTS

| | | | | |
|---|---|---|---|---|
| 895,898 | A | 8/1908 | Scheer | |
| 1,389,697 | A | 9/1921 | Phipps | |
| 1,624,950 | A | 4/1927 | Hoard | |
| 1,724,852 | A | 8/1929 | Scott | |
| 2,911,245 | A | 11/1959 | Kurz | |
| 2,945,241 | A | 7/1960 | Sideroff | |
| 3,336,605 | A * | 8/1967 | Neunherz et al. | 5/9.1 |
| 3,747,134 | A | 7/1973 | Montiague | |
| 3,967,327 | A | 7/1976 | Severson | |
| 4,179,763 | A | 12/1979 | Echavarren et al. | |
| 4,788,727 | A | 12/1988 | Liu | |
| 5,572,751 | A * | 11/1996 | Brandt | 5/9.1 |
| 5,575,023 | A * | 11/1996 | McCumber | 5/9.1 |
| 5,655,234 | A | 8/1997 | Randleas | |
| 5,865,128 | A | 2/1999 | Tarnay | |
| 6,314,595 | B1 | 11/2001 | Price | |
| 2002/0092445 | A1 | 7/2002 | Glover et al. | |

* cited by examiner

*Primary Examiner*—Heather Shackelford
*Assistant Examiner*—Fredrick Conley

(57) ABSTRACT

A multiple configuration bed frame system for allowing a single or multiple bed frames to be configured in many different ways to accommodate available space and the creativity of the user includes at least one main frame member, an optional rail member, raised bed leg members, and short leg members that also serve as frame connectors for joining two or more main frame members. A plurality of receivers are coupled to the main frame member and positioned to permit joining of the components of the invention to form the various configurations.

17 Claims, 7 Drawing Sheets

MULTIPLE CONFIGURATION BED FRAME SYSTEM

BACKGROUND OF THE INVENTION

1. Field of the Invention

The present invention relates to bed frames and more particularly pertains to a new multiple configuration bed frame system for allowing a single or multiple bed frames to be configured in many different ways to accommodate available space and the creativity of the user.

2. Description of the Prior Art

The use of bed frames is known in the prior art. U.S. Pat. No. 6,314,595 issued to Price describes an interlocking bed frame with an integrated ladder and safety rail. The Price device has a number of individual bars and rails that interconnect and are held in place by pins extending through the corner posts.

Another type of bed frame is U.S. Pat. No. 2,945,241 issued to Sideroff. The Sideroff patent discloses a convertible bed that is expandable from a configuration having the appearance of a single bed to a configuration having multiple beds or bunks. U.S. Pat. No. 4,788,727 issued to Liu discloses a collapsible base frame for supporting a bed, particularly a water-filled mattress. U.S. Pat. No. 3,967,327 issued to Severson discloses a foldable bed assembly having multiple cot-like frames positionable in a bunk like configuration. U.S. Pat. No. 5,655,234 issued to Randleas discloses a static frame having a lower bed and a vertically movable bunk. U.S. Pat. No. 5,911,245 issued to Kurz discloses a joint structure for a hinged frame positionable for supporting a person in a prone position. U.S. Pat. No. 1,724,852 issued to Scott discloses a hinged or collapsible bed structure. U.S. Pat. No. 4,179,763 issued to Echavarren discloses another collapsible double bunk bed structure. U.S. Pat. No. 895,898 issued to Scheer discloses a bunk bed structure using bars and posts to be easily assembled and lightweight. U.S. Pat. No. 1,389,697 issued to Phipps discloses a very simple and easily assembled double bunk bed structure. U.S. Pat. No. 1,624,950 issued to Hoard discloses a multi-function support structure for use as a slumber bed, cooling board, and casket support. U.S. Pat. No. 3,747,134 issued to Montiague discloses a sofa convertible into a double bunk bed structure. U.S. Pat. No. 5,865,128 issued to Tarnay discloses a folding leg mechanism for supporting a planar structure such as a table or mattress support. The published U.S. patent application No. 2002/0092445 of Glover et al. discloses a collapsible and folding banquet table.

While these devices fulfill their respective, particular objectives and requirements, the need remains for a system that provides even greater flexibility in the possible configurations and superior storage potential of unused component parts.

SUMMARY OF THE INVENTION

The present invention meets the needs presented above by providing a bed frame system having component bed frames, leg and rail structures, and storage options for compactly storing unused components. The components of each bed frame unit will interlock with another bed frame unit to permit multiple configurations having multiple bed spaces.

An object of the present invention is to provide a new multiple configuration bed frame system that has storage options for unused components to prevent loss of component parts.

Another object of the present invention is to provide a new multiple configuration bed frame system that provides myriad configuration possibilities to permit users having traditionally few furniture options, such as college dorm residents, to exercise creativity in configuring necessary furniture.

Still another object of the present invention is to provide a new multiple configuration bed frame system that efficiently utilizes available space.

Even another object of the present invention is to provide a new multiple configuration bed frame system that allows compact positioning of multiple bed spaces within a small area.

Yet another object of the present invention is to provide a new multiple configuration bed frame system that is easily assembled and disassembled to permit efficient reconfiguration of the bed structure.

Still even another object of the present invention is to provide a new multiple configuration bed frame system that is durable, sturdy and stable.

To this end, the present invention generally comprises at least one main frame member, an optional rail member, raised bed leg members, and short leg members that also serve as frame connectors for joining two or more main frame members. A plurality of receivers are coupled to the main frame member and positioned to permit joining of the components of the invention to form various configurations.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
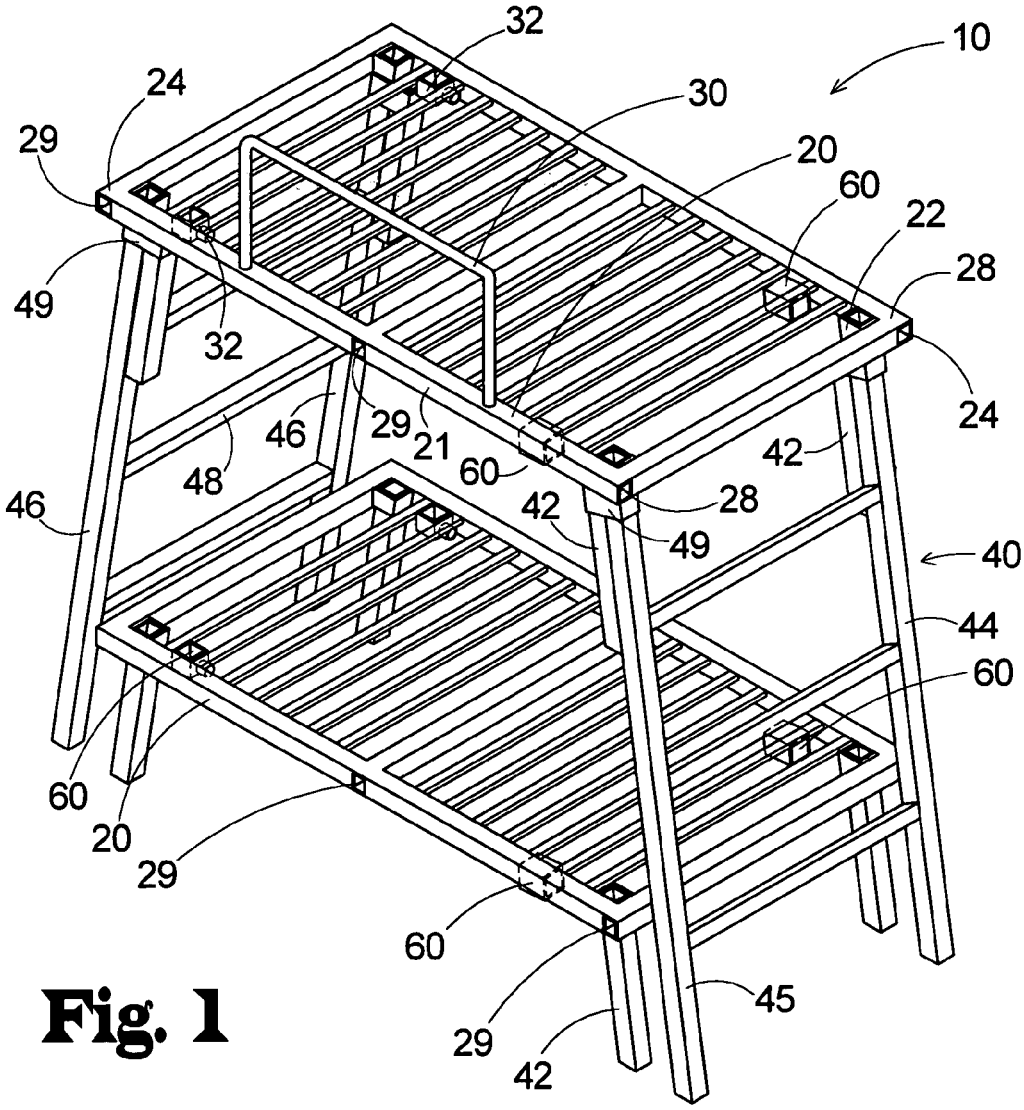
FIG. 1 is a perspective view of a new multiple configuration bed frame system according to the present invention.

With reference now to the drawings, and in particular to FIGS. 1 through 7 thereof, a new multiple configuration bed frame system embodying the principles and concepts of the present invention and generally designated by the reference numeral 10 will be described.

As best illustrated in FIGS. 1 through 7, the multiple configuration bed frame system 10 in the simplest form generally comprises a main frame member 20 and a plurality of leg members 40. A plurality of leg connection members 22 are coupled to the main frame member 20 for attaching the leg members 40 to the main frame member 20 to support the main frame member 20. The main frame member 20 includes cross members for supporting a mattress. The plurality of leg members 40 includes short leg members 42 and elevated leg members 44. The elevated leg members 44 each include a pair of outer side members 46 and cross members 48 extending between the outer side members 46. The cross members 48 form a ladder 50 for facilitating access to the main frame member 20 when the main frame member 20 is supported by the elevated leg members 44. The elevated leg members 44 have a length greater than the short leg members 42 for supporting the main frame member 20 at a higher elevation than the short leg members 42. Thus, by selecting either the short or elevated leg members, the main frame member is positionable at different elevations.

Leg locking means 52 are provided for securely coupling each of the leg members 40 to a selectable one of the leg connection members 22. The typical leg locking means 52 comprises each leg member having a biased protrusion extending through an aperture adjacent to the inserted end of the leg member. The protrusion is pushed into the leg member to permit insertion of the leg member into the leg connection member. Each leg connection member includes an aperture for receiving the protrusion, thus locking the leg member in place. Removal is achieved by pressing on the protrusion directly when the leg connection member has an aperture that exposes the protrusion.

The leg connection members 22 include end leg connection members 23 that are pitched outwardly such that lower ends 45 of the elevated legs 44 are spaced when the elevated leg members 44 are coupled to the end leg connection members 23. The outward pitching and length of the elevated leg members 44 permits positioning of a second main frame member 20 beneath a main frame member 20 supported by elevated leg members 44 when the second main frame member is supported by short leg members 42. The depth of the leg receivers is preferably not greater than the depth of the main frame member to prevent the leg receivers from protruding downwardly from the main frame member. However, additional support for the leg members may be obtained by utilizing leg receivers having greater depth.

In an embodiment, a rail member 30 is couplable to the main frame member 20. A pair of rail collars 32 are coupled to the main frame member 20 and positioned on an underside of the main frame member 20. The rail collars 32 are positioned to hold the rail member 30 in a storage position extending along the underside of the main frame member 20.

For connection of the rail member 30 to the main frame member 20, the main frame member 20 includes a pair of recesses 34 positioned in spaced relationship along one long side 21 of the main frame member 20. The rail member has a pair of opposite ends 31 insertable into the recesses 34 such that the rail member 30 extends up from the long side 21 of the main frame member 20.

Rail locking means 36 are provided for releasably securing the opposite ends 31 of the rail member 30 in the recesses 34. The rail locking means also employs a biased protrusion similar to the leg locking means 52 except the biased protrusion is rigidly attached to a button portion remote from the protrusion such that pushing on the button portion will retract the protrusion into the rail member to permit removal of the rail member from the depression in the main frame member. It is to be understood that the rail member may be attached to a collar extending from the main frame member and utilizing a locking means similar in structure to the leg locking means 52. Conversely, the leg connection members may restrict direct access to the biased protrusion of locking means 52 in which case a locking means similar to rail locking means 36 may be employed.

The main frame member 20 further has a plurality of interconnection receivers 24 for facilitating interconnection of multiple main frame members. Each of the interconnection receivers 24 is structured to receive a selectable one of the leg members 40, typically one of the short leg members 42, such that leg member 40 is partially inserted into the main frame member 20 and extends outwardly from the main frame member 20. The extending portion of the leg member 40 is then insertable into a selectable interconnection receiver 24 of a second main frame member 20 to couple the main frame members together. Leg members 42 have locking means 52 on each end for securely interconnection the main frames.

Figure 2:
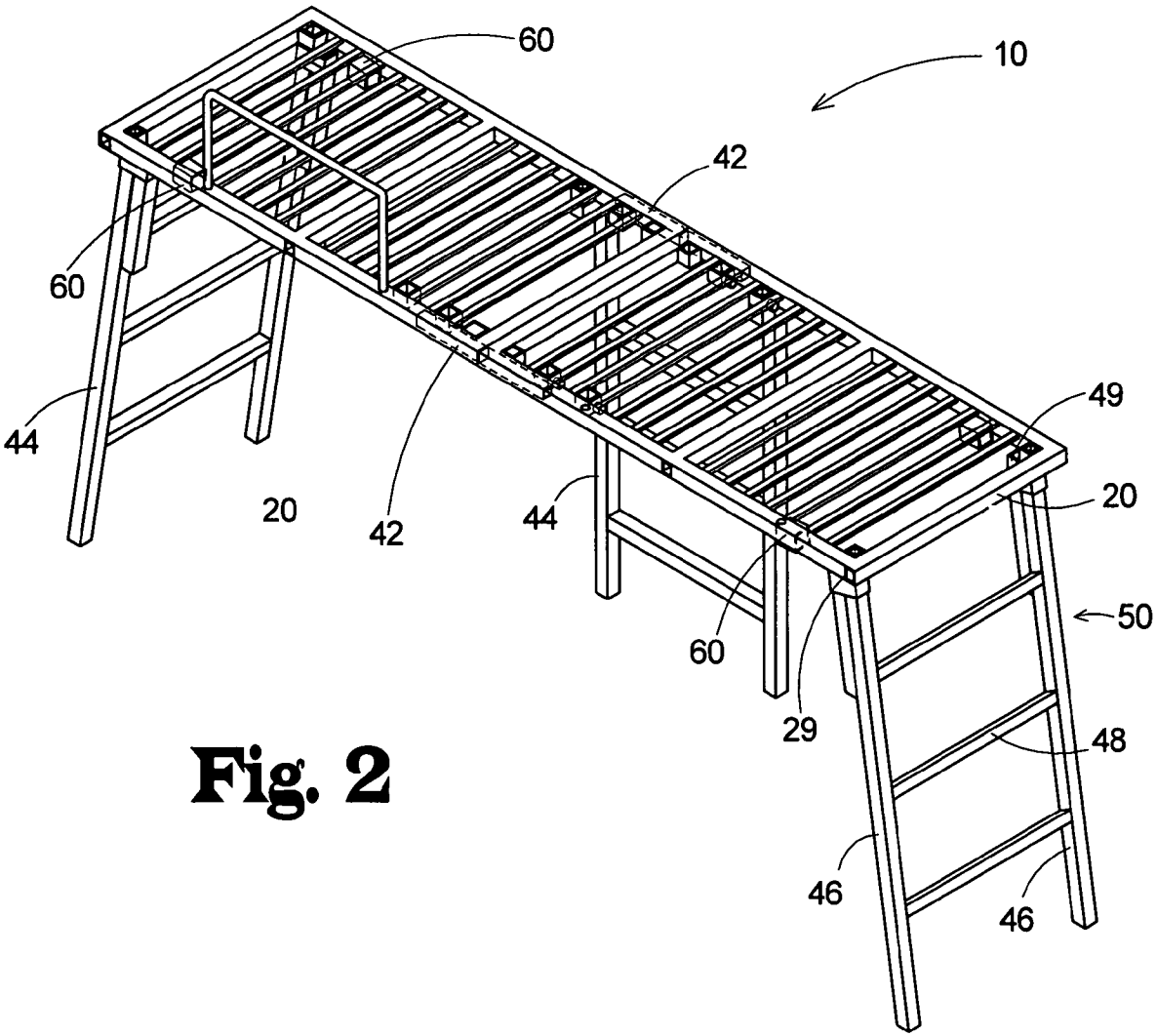
FIG. 2 is a perspective view of the present invention in an end to end configuration.
Figure 3:
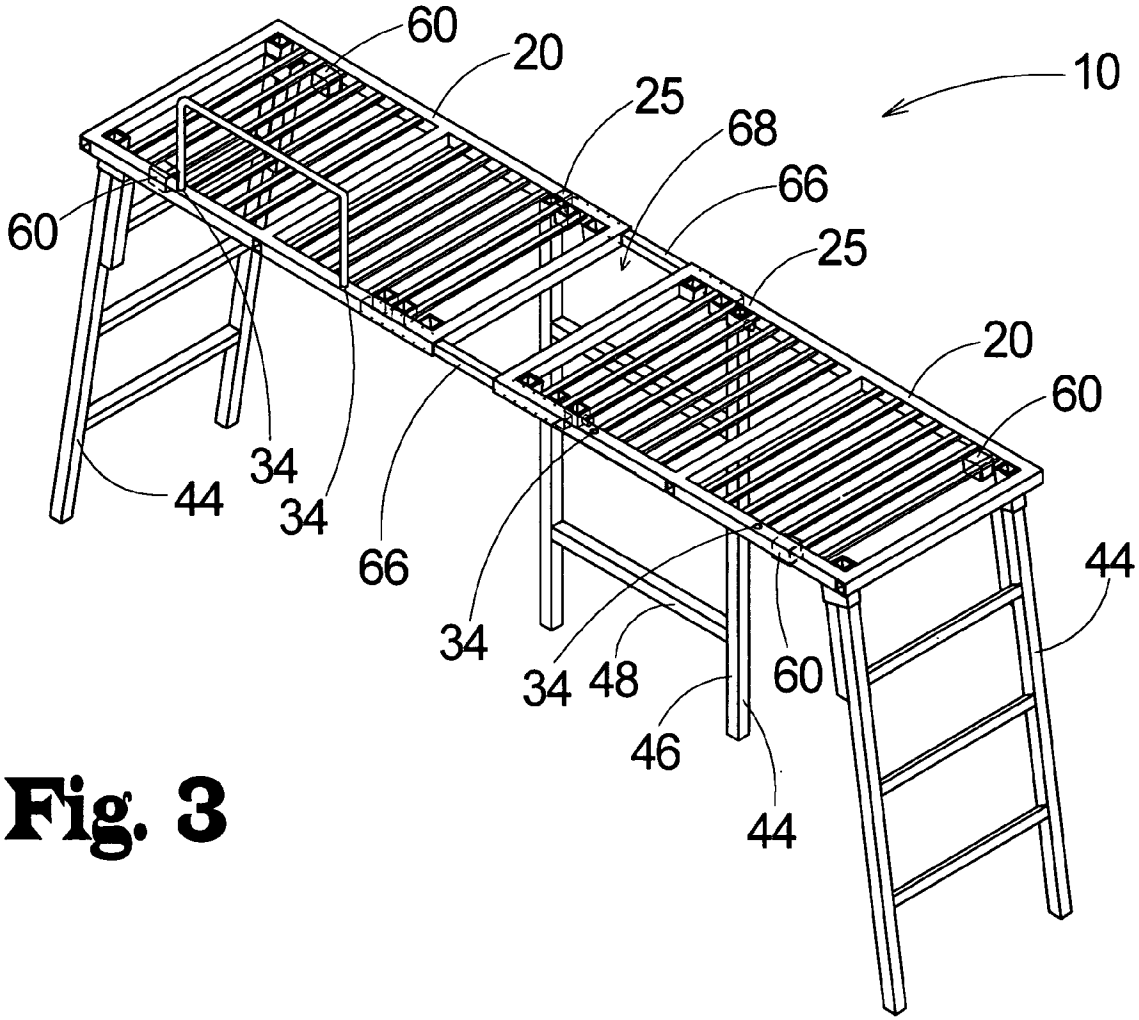
FIG. 3 is a perspective view of the present invention in a spaced end to end configuration.

The interconnection receivers 24 of each frame member includes a pair of end connection receivers 28. Thus, first and second main frame members 20 are couplable to each other by alignment of the main frame members and insertion of leg members 40 into the end connection receivers 28 to form an end to end configuration as seen in FIG. 2.

In an embodiment, each of the main frame members 20 has a respective side leg receiver 25 positioned in spaced relationship to an end of the main frame member 20. The side leg receivers 25 are for receiving a respective one of the outer side members 46 of one of the elevated leg members 44 when the main frame members 20 are in the end to end configuration. Thus, an elevated leg member 44 is positioned along a side of the end to end positioned main frame members 20. However, the strength of materials used is preferably sufficient to make use of the elevated leg member 44 along a side of the end to end configuration optional.

Figure 4:
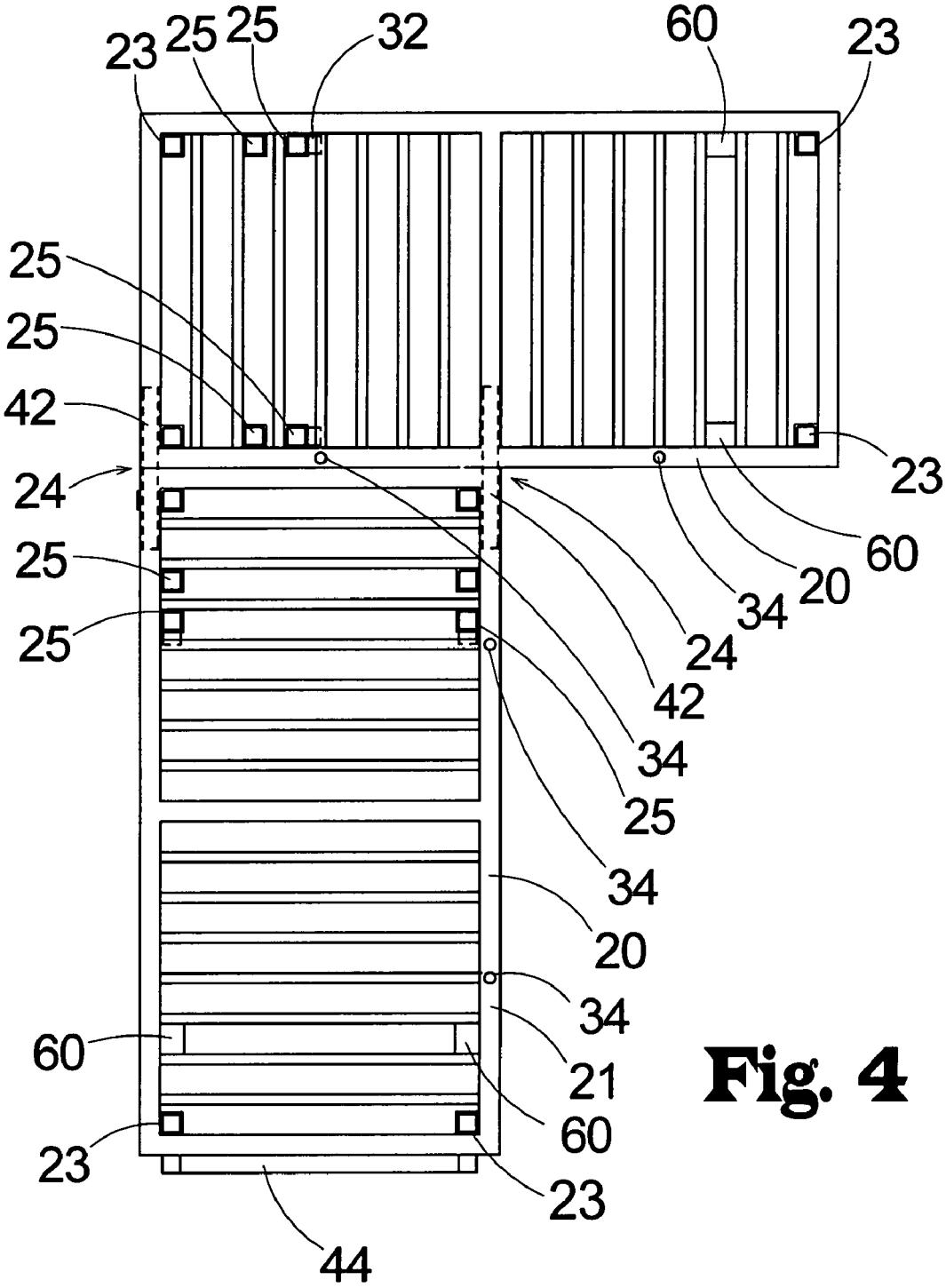
FIG. 4 is a top view of the present invention in an L-shaped configuration.
Figure 5:
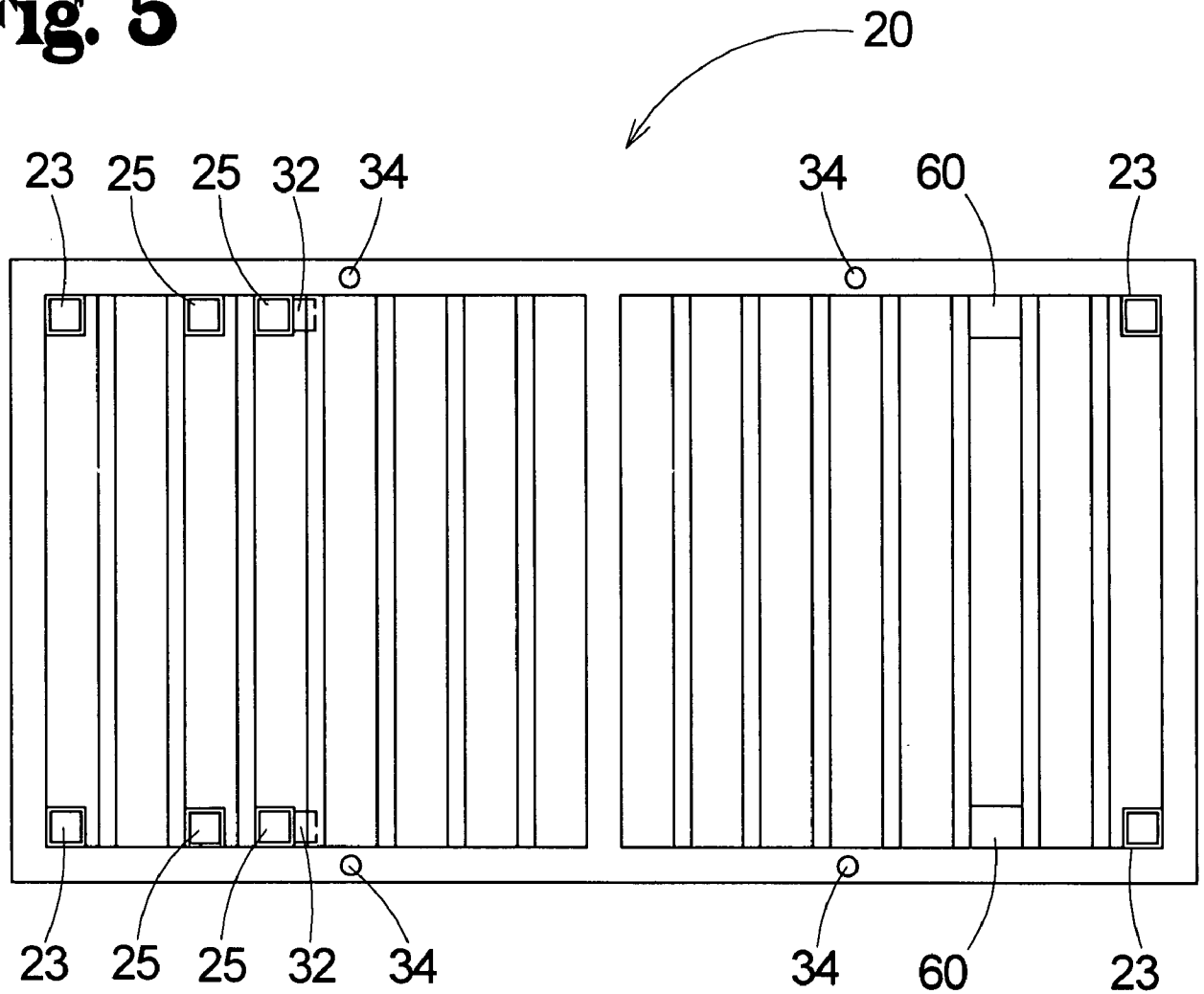
FIG. 5 is a bottom view of the main frame member of the present invention.
Figure 6:
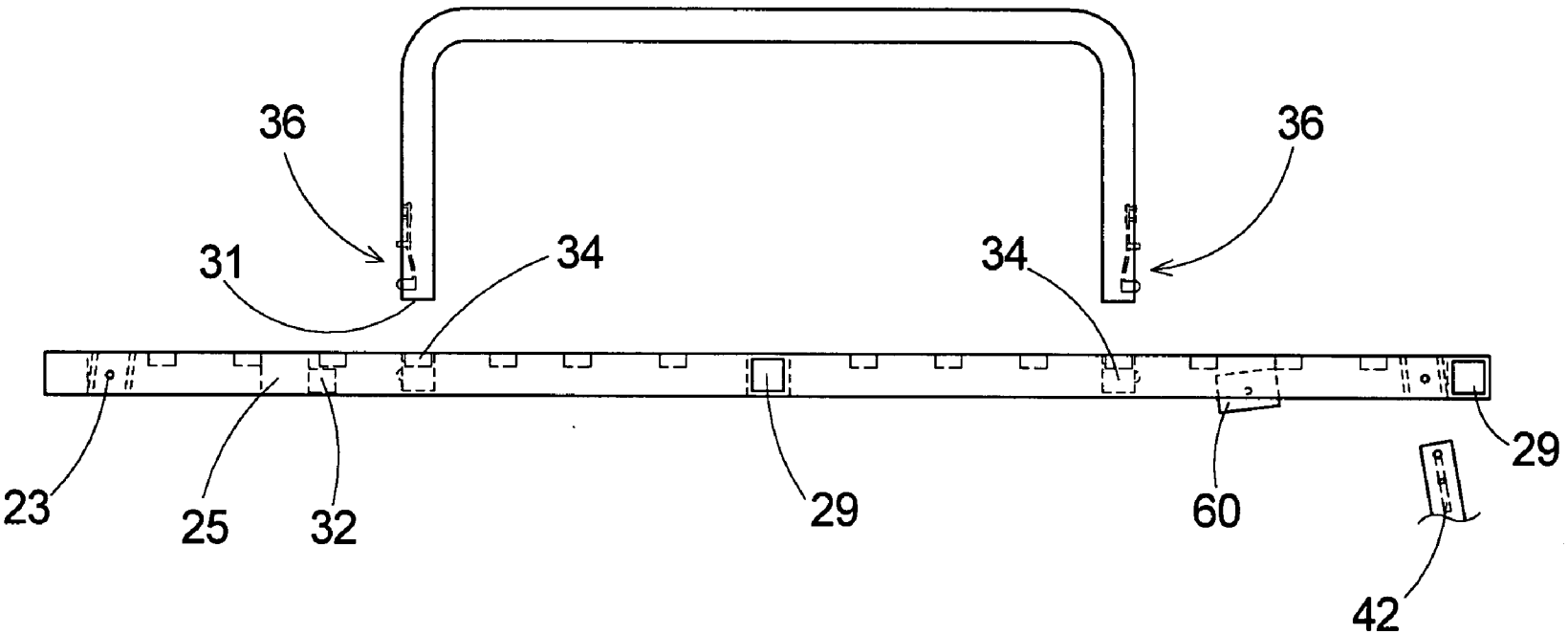
FIG. 6 is a side view of the main frame member of the present invention.

The interconnection receivers 24 of the main frame members 20 also include a pair of side connection receivers 29. The side connection receivers 29 are spaced to conform to the spacing of the end connection receivers 28. Thus, first and second main frame members 20 are couplable to each other to form an L-shaped configuration as seen in FIG. 4.

Support members 66 are insertable into the interconnection receivers 24 for coupling main frame members 20 together in spaced relationship to each other. The support members 66 have a length longer than the short leg member 42 to permit ample support of the main frame members and the desired spacing. The side leg receivers 25 are positioned appropriately from the ends of the main frame members to permit coupling of the elevated leg members 44 to extend along the side and between the spaced end to end main frame members. When in the spaced end to end configuration, the cross members 48 of the elevated leg member 44 positioned between the main frame members forms a ladder for facilitating access to the main frame members through an opening 68 formed between the main frame members and the support members.

It is to be understood that the inventive system may include main frame members having a limited number of specifically positioned interconnection receivers to permit only specific configurations between given main frame members. However, full functionality and creativity is provided by each main frame member having the full compliment of interconnection members to permit the maximum number of possible configurations.

A plurality of leg storage receivers 60 are coupled to the main frame member 20 for facilitating storage of unused leg members 40. Typically, the leg storage receivers 60 are coupled to the underside of the main frame member and pitched slightly downward to prevent interference between the stored rail member and a stored elevated leg member attached to the leg storage receivers 60.

Figure 7:
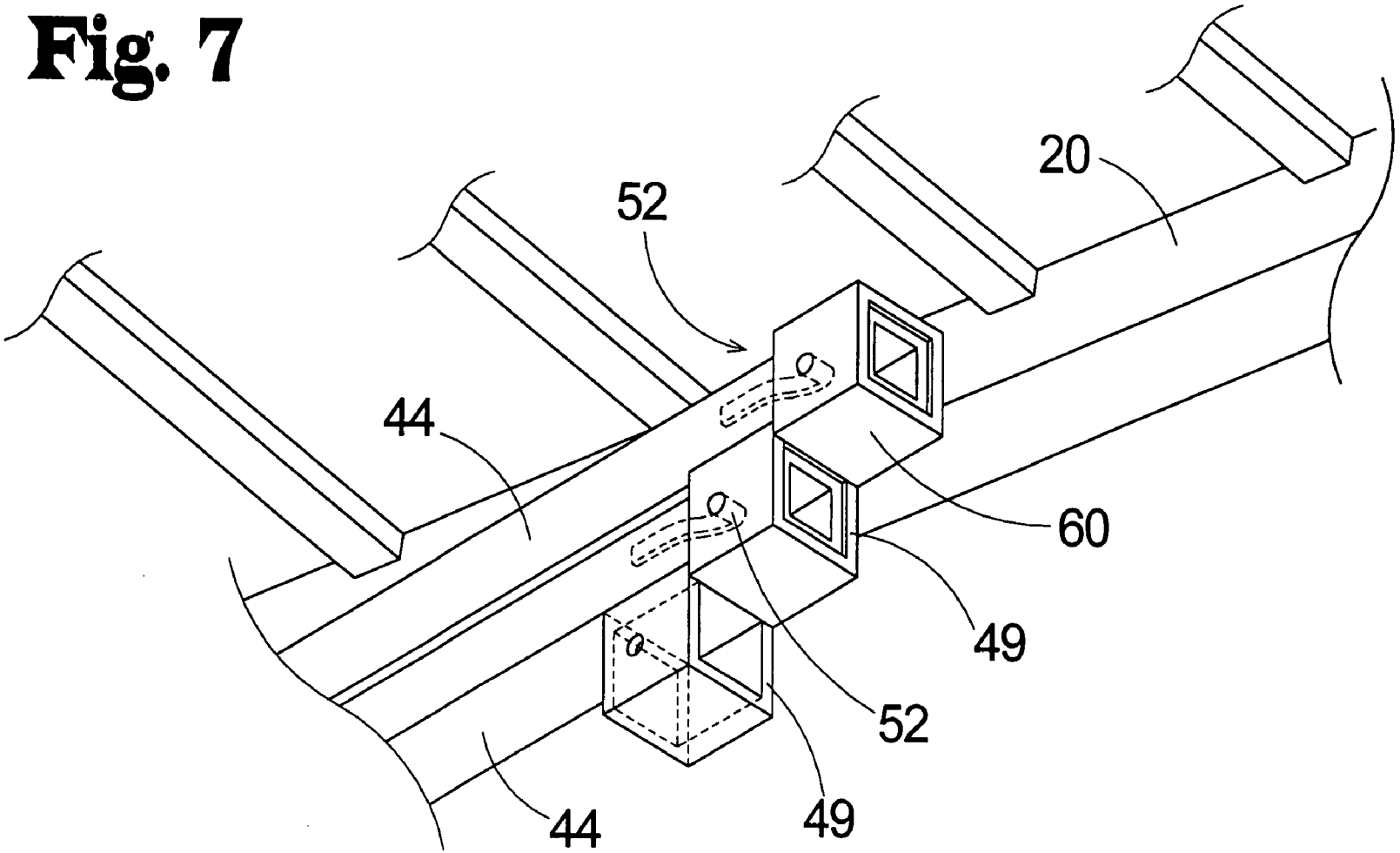
FIG. 7 is a side view of the attachment means of the present invention.

The elevated leg members 44 also include storage collars 49. The storage collars 49 are positioned and spaced such that the elevated leg members 44 are nestable in series for storing a plurality of elevated leg members 44 coupled to the main frame member 20 as shown in FIG. 7. Due to the uniform sizing of the leg members and various receivers and collars, the short leg members 42 are also couplable to either the leg storage receivers 60 or the storage collars 49. Further, the positioning of the storage collars 49 aligns below at least one of the cross members of the main frame to provide potential support to the main frame in the event the locking means of the elevated leg member fails and the upper end of the elevated leg member begins to pass through the receiver. In the event failure occurs, the cross member will contact the storage collars of the elevated leg member as an added safety feature to minimize the chance for significant injury during use.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A multiple configuration bed frame system comprising:

a main frame member;

a plurality of leg members;

a plurality of leg connection members coupled to said main frame member for attaching said leg members to said main frame member to support main frame member;

said main frame member having a plurality of interconnection receivers, each of said interconnection receivers being structured to receive a selectable one of said leg members such that said selectable one of said leg members extends from said main frame member in one of two selectable configurations;

a first configuration comprising connection of said leg members vertically to said interconnection receiver such that the lower ends of said leg members would be positioned as to connect to a second said main frame member;

a second configuration comprising connection of said leg members to said interconnection receivers in an outwardly pitched angle such that the lower ends of said leg member are arranged with sufficient space to permit the placement of a second said main frame member beneath the first said main frame member without contact with said legs.

2. A multiple configuration bed frame system of claim 1 further comprising:

spring biased leg locking means for securely coupling each of said leg members to a selectable one of said leg connection members.

3. The multiple configuration bed frame system of claim 1, further comprising:

said elevated leg members including a pair of outer side members and cross members extending between said outer side members, said cross members forming a ladder for facilitating access to said main frame member when said main frame member is supported by said elevated leg members.

4. A multiple configuration bed frame system of claim 1 further comprising:

a rail member couplable to said main frame member in a plurality of positions;

a first position fore use extending parallel to and up from the long side of said mainframe;

a second position for storage extending perpendicular to and generally below said long side of said mainframe.

5. A multiple configuration bed frame system of claim 4 further comprising:

pairs of collars couplable to said main frame member in a plurality of positions;

a first position for use placed such that said rail would extend parallel to and up from the long side of said mainframe;

a second position for storage placed such that said rail would extend perpendicular to and generally below said long side of said mainframe.

6. The multiple configuration bed frame system of claim 4 wherein said main frame includes a pair of recesses positioned in spaced relationship along one long side of said main frame member, said rail member having a pair of opposite ends insertable into said recesses such that said rail member extends up from said long side of said main frame member.

7. The multiple configuration bed frame system of claim 6 further comprising:

rail locking means for releasably securing said opposite ends of said rail member in said recesses.

8. The multiple configuration bed frame system of claim 6 further comprising:

said interconnection receivers of one of said first and second main frame members including a pair of side connection receivers, said side connection receivers being spaced to conform to the spacing of said end connection receivers whereby said first and second main frame members are couplable to each other to form an L-shaped configuration.

9. The multiple configuration bed frame system of claim 1, further comprising:

said plurality of leg members including short leg members and elevated leg members, said leg members having a length greater than said short leg members for supporting said main frame member at a higher level than said short leg member.

10. The multiple configuration bed frame system of claim 9 further comprising:

said leg connection members including end leg connection members pitched outwardly such that lower ends of said elevated legs are spaced when said elevated leg members are coupled to said end leg connection members to permit positioning of said second main frame member beneath said main frame member between said elevated leg members when said second main frame member is supported by said short leg members.

11. The multiple configuration bed frame system of claim 9 further comprising:

a plurality of leg storage receivers coupled to said main frame member for facilitating storage of unused leg members.

12. The multiple configuration bed frame system of claim 11 further comprising:

said elevated leg members including storage collars, said storage collars being positioned such that said elevated leg members are nestable in series for storing a plurality of elevated leg members coupled to said main frame member.

13. A multiple configuration bed frame system comprising:

a main frame member;

a plurality of leg members;

a plurality of leg connection members coupled to said main frame member for attaching said leg members to said main frame member to support main frame member;

said main frame member having a plurality of interconnection receivers, each of said interconnection receivers being structured to receive a selectable one of said leg members;

each said plurality of interconnection receivers of said first mainframe member and a second mainframe member including a pair of end connection receivers whereby said first and second main frame members are couplable to each other to form an end to end configuration within the same relative horizontal plane.

14. multiple configuration bed frame system of claim 13 further comprising:

said plurality of leg members including elevated leg members each having a pair of outer side members;

each of said first and second main frame members having a respective side leg receiver positioned for receiving a respective one of said outer side members of one of said elevated leg members when said first and second main frame members are in said end to end configuration within the same relative horizontal plane whereby said elevated leg member is positioned along a side of said end to end positioned main frame members.

15. The multiple configuration bed frame system of claim 13 further comprising:

support members insertable into said interconnection receivers for coupling said first and second main frame members together in spaced relationship and within the same relative horizontal plane to each other.

16. The multiple configuration bed frame system of claim 15 further comprising:

said plurality of leg members including elevated leg members each having a pair of outer side members and cross members extending between said outer side members;

each of said first and second main frame members having a respective side leg receiver positioned for receiving a respective side of one of said outer side members of one of said elevated leg members when said first and second main frame members are in a spaced end to end configuration whereby said elevated leg member is positioned along a side and between said spaced end to end positioned main frame members.

17. The multiple configuration bed frame system of claim 16 further comprising:

said cross members of said elevated leg member forming a ladder for facilitating access to said first and second main frame members in an end to end position through an opening formed between said first and second main frame members and said support members.

* * * * *